United States Patent [19]

McMahon, Jr.

[11] 4,286,474

[45] Sep. 1, 1981

[54] TRIM EXECUTION DEVICE

[75] Inventor: James F. McMahon, Jr., Gates Mills, Ohio

[73] Assignee: Cleveland Controls, Incorporated, Cleveland, Ohio

[21] Appl. No.: 105,226

[22] Filed: Dec. 19, 1979

[51] Int. Cl.[3] ..... G05G 1/04

[52] U.S. Cl. ..... 74/522; 74/834; 74/96

[58] Field of Search ..... 74/96, 522, 834, 479

[56] References Cited

U.S. PATENT DOCUMENTS

| | | | |
|---|---|---|---|
| 1,686,657 | 10/1928 | Getz | 74/522 X |
| 1,892,765 | 1/1933 | Howard | 74/522 X |
| 1,952,648 | 3/1934 | Andrews et al. | 74/522 X |
| 2,305,070 | 12/1942 | Butler et al. | 74/522 X |
| 2,491,548 | 12/1949 | Branson | 74/522 X |
| 3,103,829 | 9/1963 | Basford | 74/522 X |
| 3,264,889 | 8/1966 | Machida et al. | 75/522 X |
| 4,089,624 | 5/1978 | Nichols et al. | 74/89.15 X |

*Primary Examiner*—Lawrence J. Staab

*Attorney, Agent, or Firm*—Pearne, Gordon, Sessions, McCoy & Granger

[57] ABSTRACT

A mechanical proportioning trim execution device has a fulcrumed lever which swings between fully retracted and fully advanced positions. The fulcrum is movable back and forth from a neutral point along a fulcrum path. The lever has a fulcrum-engaging slideway extending in skewed relation to the length of the lever such that when the lever is in fully retracted position the fulcrum path and slideway are parallel but become increasingly skewed as the lever moves toward the fully advanced position.

5 Claims, 4 Drawing Figures

TRIM EXECUTION DEVICE

This invention relates to a mechanical proportioning trim execution device for executing proportionate trim in a control system. Control systems in which mechanical proportioning trim execution devices are used typically include primary control means for controlling a controlled element along a range of movement via a mechanical linkage and in response to a primary signal. For example, a boiler may have a primary control means comprising a master controller and linkage means driven thereby for controlling fuel valve and damper settings for the boiler in response to sensed error in steam pressure and along a range of movement from fully closed position to fully open position.

Mechanical proportioning trim execution devices are used in such control systems to trim the position of a controlled element in response to a secondary signal with the degree of trim effected by a given secondary signal input being proportional to the degree of advance of the controlled element along its range of movement. For example, in the above boiler control system, the setting of the damper may be trimmed in response to sensed error in oxygen content of flue gases with the degree of trim effected by a given sensed error being proportional to how far the damper has advanced to open position.

Mechanical proportioning trim execution devices have heretofore involved linkages which are bulky and unusable except where generous space allowance can be made for the control installation. Such prior art devices have included "ratio lever" trimmers manufactured ca. 1969 by a no longer existing corporation, Optimum Control Corp. of Cleveland, Ohio, and currently by Cleveland Controls, Incorporated. A copy of a drawing of Optimum Control Corp. dated Aug. 31, 1959 showing a linkage using such a "ratio lever" is submitted herewith as illustrative of this prior art device. The "ratio lever" in such drawing is the central lever containing a box-like element at its top, which is in fact a housing for a trimming motor which turns a screw shaft extending downwardly within the ratio lever and threadedly carrying a nut and associated clevis, the latter being at the left end of the illustrated horizontal link. In this prior art system, correct proportioning is achieved by providing an angle of 90° between the ratio lever itself and the clevis at low fire of the controlled boiler. In this condition, actuation of the trimming motor and consequent movement of the follower on the ratio lever results in nil movement of the driven lever. However, at progressively higher primary control settings, the master control shaft or "jackshaft" is positioned progressively further and further clockwise, the angle referred to increases more and more above 90°, and the same degree of actuation of the trimming motor and follower results in more and more trimming displacement of the driven lever associated with the fan damper or other controlled element. Thus, a given degree of actuation of the trimming motor gives correct trimming displacement over a range of primary control settings. That is to say, the system provides a trim-porportioning feature.

It will be noted that such a linkage requires considerable space to accommodate a reach of reasonable length between the driving lever and the input lever associated with the jackshaft on which the ratio lever itself is mounted, and between the clevis and the driven lever.

Thus, while these proportioning trim linkages of the prior art have been effective and useful, they have not been usable unless generous space allowances could be made for their installation, a requirement that cannot be met at all, or cannot be met in a practical way, in many installations. There has, therefore, long existed a need for a trim execution linkage of the proportional type which is compact and modest in its space requirements.

It will also be seen that only with some difficulty and inconvenience can a trim execution linkage such as the "ratio lever" system described above be installed and its motion be properly calibrated, because various components such as the driving lever, jackshaft and driven lever are all separately mounted so that they must first be separately installed and then properly interconnected. In contrast, the compactness of the present invention makes it practical to package the linkage in a compact housing which can be factory calibrated and can be conveniently installed or mounted as a single unit.

The features and advantages of the invention will be better understood from the following description of a specific example.

Figure 1:
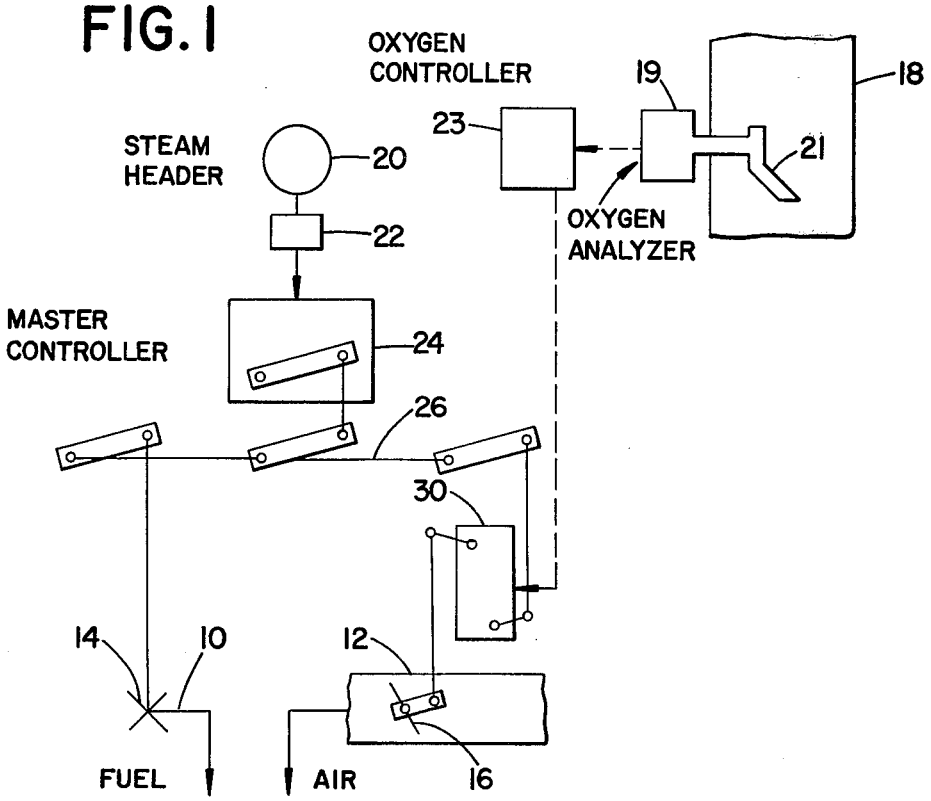
FIG. 1 is a schematic illustration of a boiler firing control system utilizing the invention.

The boiler firing control system in which the invention is used includes a burner (not shown) to which fuel is supplied by the line 10 and air is supplied by a duct 12. The flow of fuel is controlled by a valve 14 and the flow of air by a damper 16. The duct 12 is connected to a suitable blower (not shown). The products of combustion from the burner pass up through the stack 18. The burner heats a boiler (not shown) which includes a stream header 20.

A pressure transmitter 22 associated with the steam header 20 senses steam pressure and transmits this information to a master controller 24. The master controller determines any degree of sensed error in steam pressure and correspondingly adjusts a fuel valve 14 and damper 16 via the illustrated linkages, including the jackshaft 26. The fuel valve 14 is directly driven from the jackshaft 26, while the damper 16 is driven via the trim execution device 30, to be described below. When the trim execution device is set in neutral position, or at zero trim, movements of the damper 16 correlate with movements of the jackshaft 26 and the fuel valve 14 without the addition or subtraction of any trimming adjustment.

The trim execution device 30 is contained in a housing comprising the side walls 31 and 32, the end walls 33 and 34, the cover 35, and the base 36. Pairs of vertically disposed plates 41 and 42 are cantilevered from the end wall 33, as are single horizontally disposed plates 43–47.

A worm gear 49 is rotatably carried on the plates 45 and 46 by suitable bearings as illustrated and is driven in either rotatier direction by a trim motor and reduction drive 50 carried on the plate 47 and connected to the worm gear 49 by suitable clutch means 51 as illustrated. The rotative position of the worm gear 49 is sensed by suitable sensing means 52 mounted on the plate 44. The leads from the sensing means and the leads from other electrical elements are connected to a terminal strip 53 carried on the plate 43.

A travel nut 55 is threadedly engaged on the worm gear 49 and is formed as a unitary piece with shaft extensions 56. a series of bearing sleeves 57 surrounding the shaft extensions 56 are received respectively in a pair of fixed vertical slots 58 formed in the vertically disposed plates 31 and in a pair of slots 60 formed in main levers 62. In the vertical position of the main levers 62 as seen in FIG. 3, slots 60 are skewed in respect of slots 58.

Figure 2:
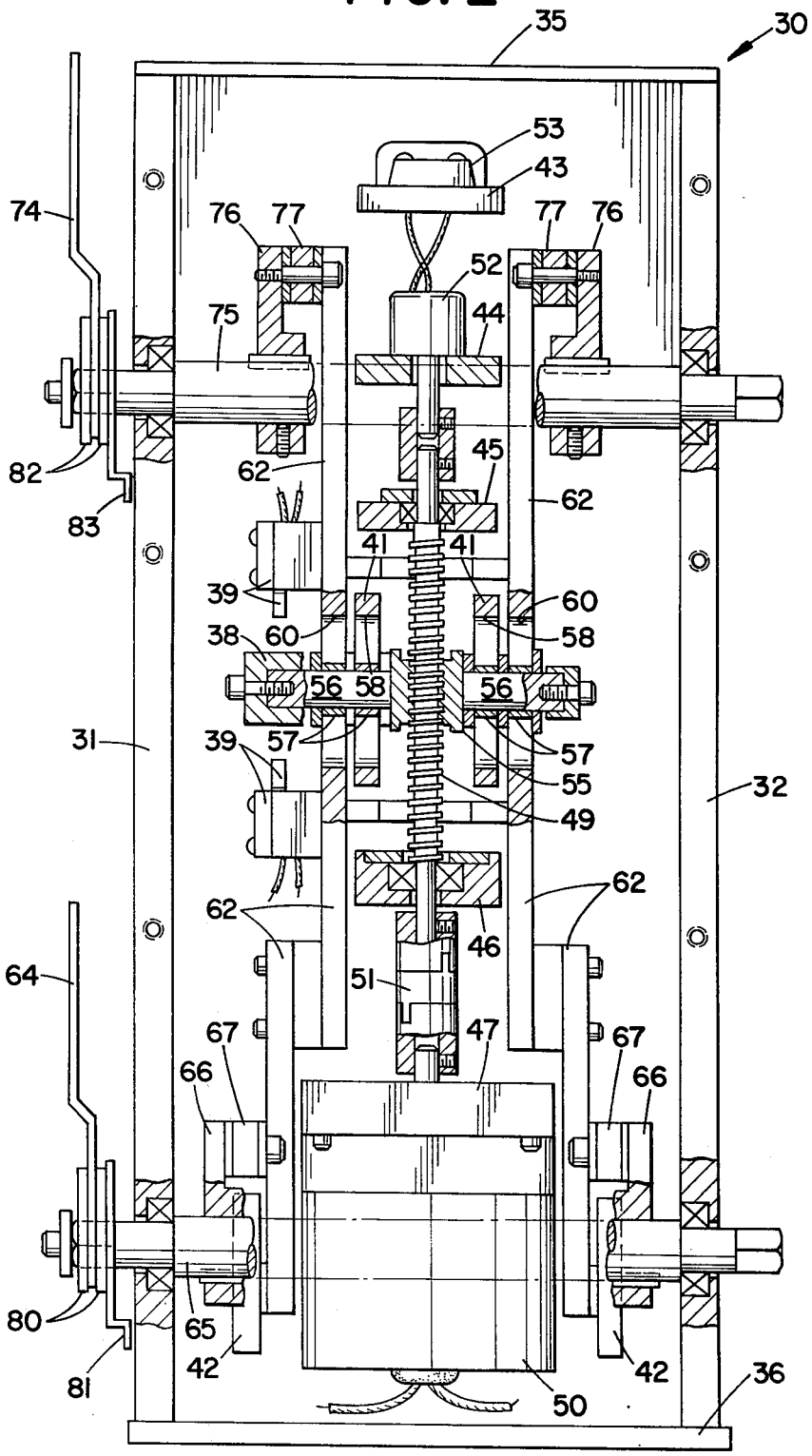
FIG. 2 is an end elevation, partly broken away, of the trim execution device employed in FIG. 1.

The bottom portions of the main levers 62 are displaced sidewise as shown in FIG. 2 to accommodate the trim motor 50. The main levers 62 are driven by a bellcrank linkage including the input lever 64, the bellcrank shaft 65, the output levers 66, and connecting links 67. A similar bellcrank linkage, comprising the output lever 74, the bellcrank shaft 75, the input levers 76, and connecting links 77, is connected to the upper or output ends of the main levers 62. The bellcrank shafts 66 and 67 are rotatably mounted in the sidewalls 31 and 32 as shown. The input lever 64 is not keyed directly to the shaft 65, but is adjustably connected to the plates 80 which are clamped or keyed to the shaft 65 in the manner shown. A pointer 81 is also carried on the shaft and is associated with a suitable scale carried on the sidewall 31. A similar arrangement may be provided at the output bellcrank linkage, with plates 82 and a pointer 83.

The bottom ends of the main levers 62 carry rollers or pins 85 which are received in arcuate slots 86 formed in the vertically disposed plates 42. These pin-and-slot connections support the main levers 62 against the tendency to move vertically downwardly to cause jamming between the shaft extensions 56 and the slots 58 and 60. The arcuate slots 86 may be centered on the central axis of the shaft extensions 56 when the travel nut 55 is in its vertically neutral position.

Figure 4:
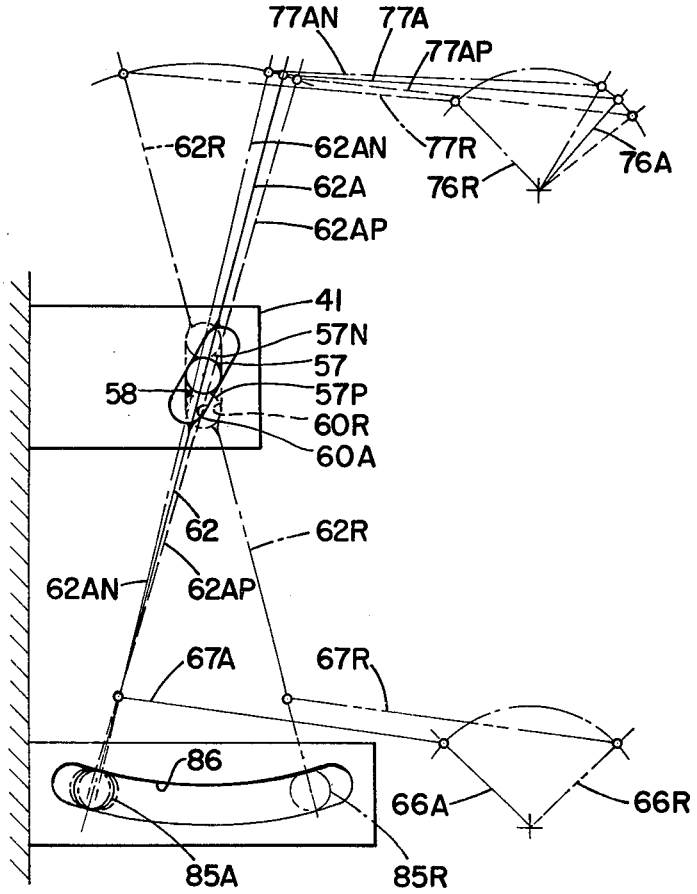
FIG. 4 is a diagrammatic illustration of the operation of the same device.
Figure 3:
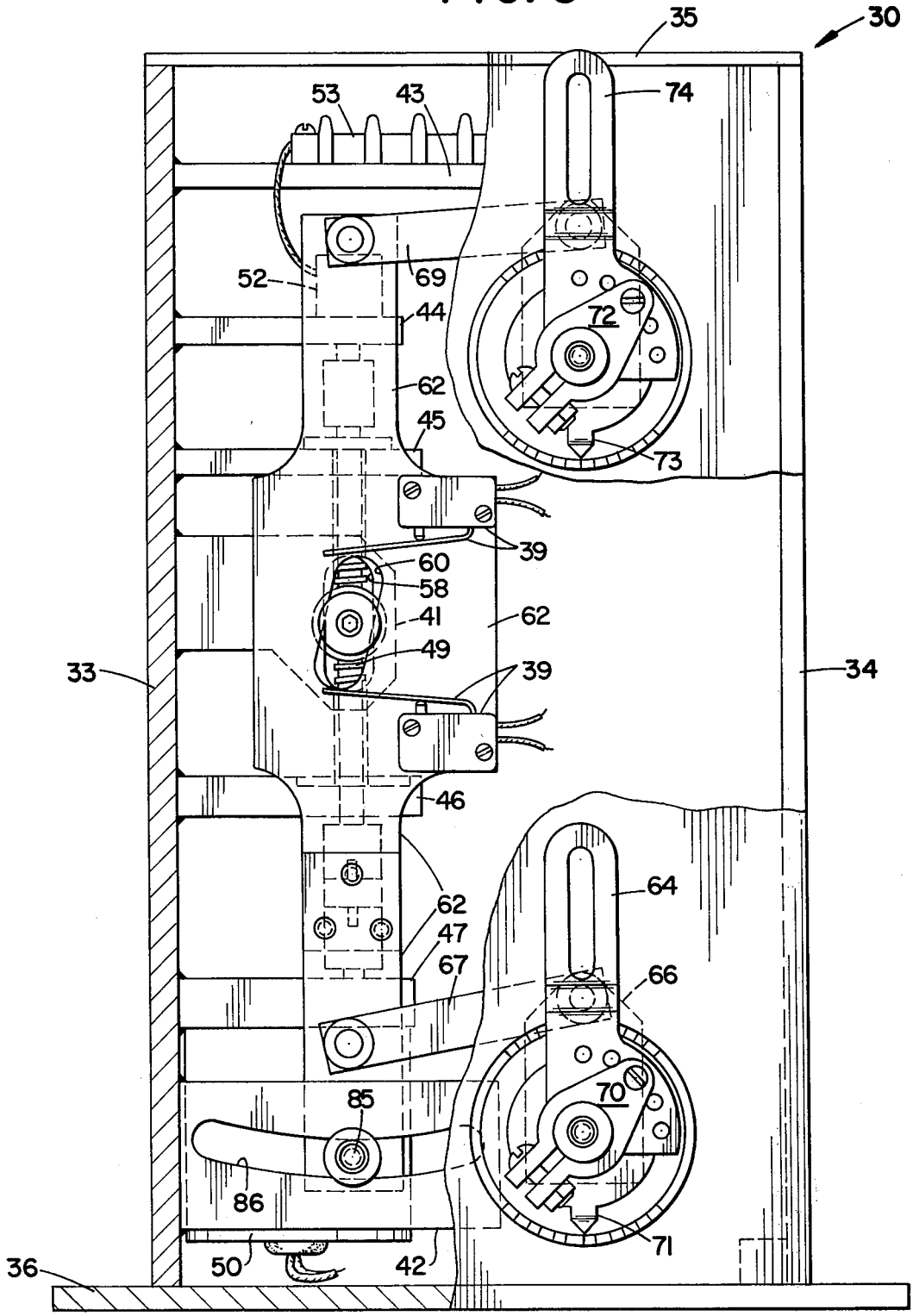
FIG. 3 is a side elevation, partly broken away, of the same device.

The apparatus as shown in FIGS. 2 and 3 is at neutral trim and is midway between fully retracted and fully advanced positions of the linkage. FIG. 4 diagrammatically illustrates the fully retracted and fully advanced positions of the linkage. FIG. 4 uses reference numbers corresponding to FIGS. 2 and 3, but in FIG. 4 the suffix letters "R" or "A" are added to the reference numbers for moving elements to indicate, respectively, their fully retracted and fully advanced positions at neutral trim. Some of the elements whose positions may be affected by trim are also shown in full-positive or full-negative trim condition at the fully advanced position of the linkage, and are labelled "AP" for fully advanced, full-positive trim or "AN" for fully advanced, full-negative trim. The shaft extensions 56 and the bearing sleeves 57 thereon do not move when the linkage is advanced or retracted, but they do move to change trim. In FIG. 4, the neutral position of the sleeves 57 is therefore labelled "57", the full-positive trim position is labelled "57P", and the full-negative trim position is labelled "57N".

Returning to the system shown in FIG. 1, an oxygen analyzer 19 associated with a probe 21 in stack 18 transmits to oxygen controller 23 information as to the percentage oxygen content of stack gases. Controller 21 determines any degree of sensed error in percentage oxygen content and sends a corresponding trim adjusting signal to trim motor 50 of trim execution device 30, to thereby trim the position of the damper 16. The trim movement of the worm 49, and therefore of the nut 55 and associated elements, is measured by sensing means 52 which feeds this information back to oxygen controller 23. Trim movement may be limited by microswitches 39 (FIGS. 2,3) which are contacted by a switch trigger sleeve 38 on an end of one of the shaft extensions 56.

The greater the advance of the linkage from fully retracted position, the greater the degree of trim. This trim proportioning action can best be seen from a study of FIG. 4. When the linkage is fully retracted, the slots 60 formed in the main levers 62 are in vertical position and are aligned with the vertical slots 58 formed in the plates 41. Accordingly, upward or downward movement of the travel nut 55 and shaft extensions 56 (not shown in FIG. 4) and associated sleeves 59 does not change the position of the main levers 62 or the other elements of the linkage.

On the other hand, when the linkage is fully advanced, upward or downward movement of the bearing sleeve 59 has maximum effect on trim. Lowering the bearing sleeves toward their lowermost position 57P forces the slots 60A forwardly and gives positive trim. Raising the bearing sleeves 59 toward their uppermost position 57N forces the slots 60A rearwardly and gives negative trim.

The further the linkage advances from fully retracted to fully advanced position, the more the degree the trimming action, resulting from a given degree of downward or upward movement of the bearing sleeves 59, increases from zero.

From the foregoing, it will be understood that the bearing sleeves 57 and shaft extensions 56 are on a common center and define the fulcrum of the main levers 62 which move around this fulcrum through the range of swinging movement illustrated in FIG. 4. It will also be seen that this fulcrum can be shifted along a fulcrum path represented by the slots 58 formed in plates 41, and that the slots 60 constitute fulcrum-engaging slideways on the main levers 62. It will be seen that at the beginning of the swinging movement, the fulcrum path and the fulcrum-engaging slideways are parallel but become increasingly skewed as the swinging movement advances, so that the greater the advance of swinging movement, the greater the lagging or leading trimming effect on the advance of departure of the fulcrum back or forth from the neutral point.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. In a control system, primary control means for controlling a controlled element along a range of movement via a mechanical linkage and in response to a primary signal, and trim linkage means for trimming the position of the controlled element in response to a secondary signal with the degree of trim effected by a given secondary signal input being proportional to the degree of advance of said controlled element along said range of movement, the improvement wherein the trim linkage means comprises a fulcrumed lever movable around a central fulcrum through a range of swinging movement of the lever, means responsive to said secondary signal for moving said fulcrum back and forth from a neutral point along a fulcrum path which is lengthwise of the lever when the lever is at the midpoint of said swinging movement, fulcrum-engaging slideway means on the lever extending in skewed relation to the length of the lever such that at said beginning of said range of swinging movement said fulcrum path and slideway means are parallel but become increasingly skewed as said swinging movement advances through said range, whereby the greater said advance of swinging movement of said lever, the greater the lagging or leading trimming effect, on said advance, of departure of said fulcrum back or forth from said neutral point, and input and output linkages connected to respective ends of said lever.

2. Apparatus as in claim 1, in which said input and output linkages each comprise a bellcrank joined to a corresponding end of said fulcrumed lever by a connecting link, and means supporting said fulcrumed lever against movement transverse to said connecting links.

3. Apparatus as in claim 1, said fulcrum path traversing means comprising a travel nut and shaft and fixed vertical guide slot means for them, and said fulcrum-engaging slideway means comprising guide slot means formed in said fulcrumed lever, said last named means being skewed with respect to said fixed guide slot means when said lever is vertically positioned.

4. Apparatus as in claim 1, including travel limit control means for terminating said secondary signal to said responsive means when the degrees of departure of said fulcrum from said neutral point in either direction exceed predetermined amounts.

5. A trimmable control mechanism for imposing trimming displacement, in response to a trim signal, on the output of a mechanical linkage which advances through a range of positions, with the degree of trim effected by a given trim signal being proportional to the degree of advance of said linkage, comprising a main lever mounted for swinging advance around a central fulcrum from a starting position on one side of vertical to a fully advanced position on the other side of vertical, fulcrum means movable in response to said trim signal back and forth from a neutral point along a vertical path, fulcrum-engaging slideway means on the main lever, said slideway means being skewed with respect to the longitudinal axis of said main lever such that said slideway means is vertical at said starting position of said main lever and is therefore parallel to said vertical fulcrum path but said slideway means and fulcrum path become increasingly skewed as said main lever advances, and input and output linkages connected to respective ends of said main lever.

* * * * *